US008037721B2

(12) United States Patent
Yoo et al.

(10) Patent No.: US 8,037,721 B2
(45) **Date of Patent: *Oct. 18, 2011**

(54) FOREIGN MATERIALS FILTERING APPARATUS AND WASHING MACHINE HAVING THE SAME

(75) Inventors: Sang-Hee Yoo, Gyeongsangnam-Do (KR); Jong-Deuk Bae, Gyeongsangnam-Do (KR); Bo-Young Chang, Gyeongsangnam-Do (KR); Young-Bae Park, Gyeongsangnam-Do (KR); Ji-Maeng Kim, Gyeongsangnam-Do (KR); Soo-Jin Jung, Gyeongsangnam-Do (KR); Ae-Na Jo, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 875 days.

This patent is subject to a terminal disclaimer.

(21) Appl. No.: 12/041,773

(22) Filed: Mar. 4, 2008

(65) Prior Publication Data

US 2008/0216518 A1 Sep. 11, 2008

(30) Foreign Application Priority Data

Mar. 6, 2007 (KR) ..... 10-2007-0022179

(51) Int. Cl.
*D06F 39/10* (2006.01)

(52) U.S. Cl. ..... 68/18 F; 210/167.01; 210/196

(58) Field of Classification Search ..... 68/18 F; 210/167.01, 196, 346
See application file for complete search history.

(56) References Cited

U.S. PATENT DOCUMENTS

| | | | |
|---|---|---|---|
| 2,413,954 | A | 1/1947 | Conterman |
| 2,586,508 | A | 1/1952 | Brotman |
| 2,939,305 | A | 12/1956 | Snyder et al. |
| 2,936,604 | A | 5/1960 | Glendening |
| 3,040,552 | A | 12/1960 | Platt et al. |
| 2,971,362 | A | 2/1961 | Olding |
| 3,027,742 | A | 4/1962 | Nowicki |
| 3,240,345 | A | 3/1966 | Butler et al. |
| 3,727,435 | A | 4/1973 | Menk |
| 3,769,818 | A | 11/1973 | Smith |
| 3,805,404 | A | 4/1974 | Gould |
| 3,836,001 | A | 9/1974 | Heldreth |
| 3,891,548 | A | 6/1975 | Marcussen |
| 3,896,641 | A | 7/1975 | Worst |
| 3,910,076 | A | 10/1975 | Ruble |
| 3,977,219 | A | 8/1976 | Bochan |

(Continued)

FOREIGN PATENT DOCUMENTS

DE 30 10 182 A1 10/1981

(Continued)

*Primary Examiner* — Joseph L. Perrin
(74) *Attorney, Agent, or Firm* — Birch, Stewart, Kolasch & Birch, LLP

(57) ABSTRACT

In a foreign materials filtering apparatus and a washing machine having the same, a filter unit is not exposed to inside of a washing tub thus not to directly come in contact with laundry, thereby preventing the filter unit and laundry from being damaged and enhancing the entire appearance. Also, the foreign materials filtering apparatus is modularized to facilitate a detachable mounting, thereby enhancing the user's convenience. Additionally, the amount of washing water passing through the foreign materials filtering apparatus is increased by controlling a flowing direction of washing water. Furthermore, foreign materials of washing water are prevented from being introduced into a gap between a washing water circulating duct and a filter unit, thereby enhancing a washing effect.

8 Claims, 9 Drawing Sheets

U.S. PATENT DOCUMENTS

| | | | | |
|---|---|---|---|---|
| 4,081,975 | A | | 4/1978 | Wortham et al. |
| 4,417,457 | A | | 11/1983 | Brenner |
| 4,566,970 | A | | 1/1986 | Piai et al. |
| 4,622,142 | A | | 11/1986 | Teranishi |
| 4,833,900 | A | | 5/1989 | Babuin et al. |
| 5,018,372 | A | | 5/1991 | Altnau, Sr. |
| 5,078,862 | A | | 1/1992 | Justice |
| 5,353,612 | A | | 10/1994 | Noguchi et al. |
| 5,437,789 | A | | 8/1995 | Sabo et al. |
| 5,509,283 | A | | 4/1996 | Lee et al. |
| 5,618,419 | A | | 4/1997 | Fuerst |
| 5,661,989 | A | * | 9/1997 | Jeon et al. ..... 68/18 F |
| 5,829,275 | A | | 11/1998 | Babuin et al. |
| 5,849,182 | A | | 12/1998 | Shin |
| 5,858,220 | A | | 1/1999 | Shin |
| 5,863,423 | A | | 1/1999 | Shin et al. |
| 5,931,027 | A | | 8/1999 | Shin |
| 5,989,418 | A | | 11/1999 | Shin |
| 6,076,378 | A | | 6/2000 | Shin |
| 6,841,058 | B2 | | 1/2005 | Culvey et al. |
| 7,267,289 | B2 | | 9/2007 | Lyons |
| 7,412,853 | B2 | | 8/2008 | Hong et al. |
| 2001/0010165 | A1 | | 8/2001 | Kubota et al. |
| 2004/0159130 | A1 | | 8/2004 | Lee |
| 2005/0000920 | A1 | | 1/2005 | Smolley |
| 2005/0132759 | A1 | | 6/2005 | Guinibert et al. |
| 2005/0246843 | A1 | | 11/2005 | Song et al. |
| 2006/0075790 | A1 | | 4/2006 | Jeon et al. |
| 2006/0096335 | A1 | | 5/2006 | Park et al. |
| 2006/0123854 | A1 | | 6/2006 | Hong et al. |
| 2006/0185403 | A1 | | 8/2006 | Ikemizu et al. |
| 2008/0141554 | A1 | | 6/2008 | Bae et al. |
| 2008/0141734 | A1 | | 6/2008 | Son et al. |
| 2008/0216518 | A1 | | 9/2008 | Yoo et al. |
| 2008/0216519 | A1 | | 9/2008 | Yoo et al. |
| 2008/0216520 | A1 | | 9/2008 | Yoo et al. |
| 2008/0216522 | A1 | | 9/2008 | Yoo et al. |
| 2008/0216523 | A1 | | 9/2008 | Yoo et al. |
| 2008/0217243 | A1 | | 9/2008 | Yoo et al. |
| 2008/0276659 | A1 | | 11/2008 | Bae et al. |
| 2008/0276661 | A1 | | 11/2008 | Bae et al. |
| 2008/0302138 | A1 | | 12/2008 | Bae et al. |
| 2008/0313922 | A1 | | 12/2008 | Bae et al. |
| 2009/0078007 | A1 | | 3/2009 | Bae et al. |
| 2009/0100882 | A1 | | 4/2009 | Bae et al. |
| 2009/0113745 | A1 | | 5/2009 | Choi et al. |
| 2009/0120140 | A1 | | 5/2009 | Choi et al. |

FOREIGN PATENT DOCUMENTS

| | | | |
|---|---|---|---|
| EP | 0 735 179 | A1 | 10/1996 |
| JP | 02-005998 | A | 1/1990 |
| JP | 2-114993 | A | 4/1990 |
| JP | 6-319895 | A | 11/1994 |
| JP | 08-323096 | A | 12/1996 |
| JP | 09-299685 | A | 11/1997 |
| JP | 10-000293 | A | 1/1998 |
| JP | 11-207091 | A | 8/1999 |
| JP | 2000-354697 | A | 12/2000 |
| KR | 10-2001-0073573 | A | 8/2001 |
| KR | 10-2002-0045381 | A | 6/2002 |
| WO | WO 2005/118940 | A1 | 12/2005 |

* cited by examiner

FOREIGN MATERIALS FILTERING APPARATUS AND WASHING MACHINE HAVING THE SAME

RELATED APPLICATION

The present invention relates to subject matter contained in priority Korean Application No. 10-2007-0022179, filed on Mar. 6, 2007, which is herein expressly incorporated by reference in its entirety.

BACKGROUND OF THE INVENTION

1. Field of the Invention

The present invention relates to a foreign materials filtering apparatus, and more particularly to a foreign materials filtering apparatus for a washing machine and a washing machine having the same.

2. Description of the Background Art

Generally, a washing machine is largely classified into a drum type washing machine that a washing tub rotates in a horizontal direction with respect to the ground, and a pulsator type washing machine the washing tub rotates in a vertical direction with respect to the ground. According to the drum type washing machine, while a washing tub rotates, laundry comes into friction with an inner wall of the washing tub or drops from the washing tub thereby to be cleaned. On the contrary, according to the pulsator type washing machine, laundry comes into friction with a water current generated while a pulsator rotates, or is entangled by the pulsator, thereby being cleaned.

In the conventional pulsator type washing machine a foreign materials filtering apparatus for filtering each kind of foreign materials such as nap generated from laundry during a washing process is installed above the washing tub.

In the foreign materials filtering apparatus, a filtering net for filtering foreign materials is attached to a frame detachably mounted at the washing tub. The frame is formed of an elastic material in a rectangular belt shape so as to be detachably mounted at the washing tub. And, the filtering net is formed of a mesh-shaped fibrous material or a material similar thereto having a certain aperture ratio so as to pass washing water and filter foreign materials.

In a washing machine having the foreign materials filtering apparatus, a pulsator provided on a bottom surface of a washing tub rotates to generate a water current, and by the generated water current, washing water rises along a passage formed between an inner wall and an outer wall of the washing tub. The risen washing water is introduced into the washing tub via the foreign materials filtering apparatus. While the washing water passes through the foreign materials filtering apparatus, foreign materials such as nap detached from laundry and mixed with the washing water are filtered by passing through a filtering net of the foreign materials filtering apparatus.

However, the conventional foreign materials filtering apparatus has the following problems.

First, the filtering net is installed to be exposed to inside of the washing tub, thereby repeatedly coming in contact with laundry. Accordingly, the filtering net or laundry may be damaged, or the frame may be detached from the washing tub, which causes the entire appearance to be degraded.

Second, since a washing water inlet communicated with the filtering net is formed on the plane, washing water is not smoothly introduced into the foreign materials filtering apparatus. Accordingly, the efficiency to remove foreign materials from washing water is degraded.

Third, when a gap is generated at a coupled part of the filtering net to another member, foreign materials are introduced into the gap thus to cause bacterial breeding, or to have a difficulty in detachably mounting the filtering net at the coupled part.

SUMMARY OF THE INVENTION

Therefore, it is an object of the present invention to provide a foreign materials filtering apparatus capable of preventing a filtering net and laundry from being damaged by preventing friction therebetween, and capable of enhancing a drain function and the entire appearance at the time of installing the filtering net, and a washing machine having the same.

It is another object of the present invention to provide a foreign materials filtering apparatus capable of enhancing efficiency to remove foreign materials from washing water by smoothly introducing washing water into a washing water inlet, and a washing machine having the same.

It is still another object of the present invention to provide a foreign materials filtering apparatus capable of preventing foreign materials from being introduced into its coupled part, and a washing machine having the same.

To achieve these and other advantages and in accordance with the purpose of the present invention, as embodied and broadly described herein, there is provided a foreign materials filtering apparatus, comprising: a washing water circulating duct having one or more washing water inlets, and installed at a washing tub; a filter cover mounted so as to cover the washing water inlets; and a filter unit disposed between the washing water circulating duct and the filter cover, for filtering foreign materials from washing water.

According to another aspect of the present invention, there is provided a foreign materials filtering apparatus, comprising: a washing water circulating duct having one or more washing water inlets, and installed at a washing tub; a filter cover mounted so as to cover the washing water inlets; and a filter unit disposed between the washing water circulating duct and the filter cover, for filtering foreign materials from washing water.

To achieve these and other advantages and in accordance with the purpose of the present invention, as embodied and broadly described herein, there is also provided a washing machine having a foreign materials filtering apparatus, comprising: a cabinet; a reservoir received in the cabinet, for containing washing water therein; a washing tub received in the reservoir, and rotated at the time of a washing or dehydrating process, for containing laundry therein; a pulsator installed at the washing tub, for stirring laundry; and a foreign materials filtering apparatus comprising: a washing water circulating duct installed on an inner circumferential surface of the washing tub, having a washing water guiding passage, having one or more washing water inlets inside the washing water guiding passage, and having, near the washing water inlets, a water direction changing rib which changes a flow direction of washing water, for circulating washing water when the pulsator rotates; a filter cover mounted at the washing water circulating duct and having drain holes so as to communicate with the washing water inlets; and a filter unit disposed between the washing water circulating duct and the filter cover, for filtering foreign materials from washing water.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, a foreign materials filtering apparatus and a washing machine having the same according to the present invention will be explained in more detail with reference to the attached drawings.

Figure 1:
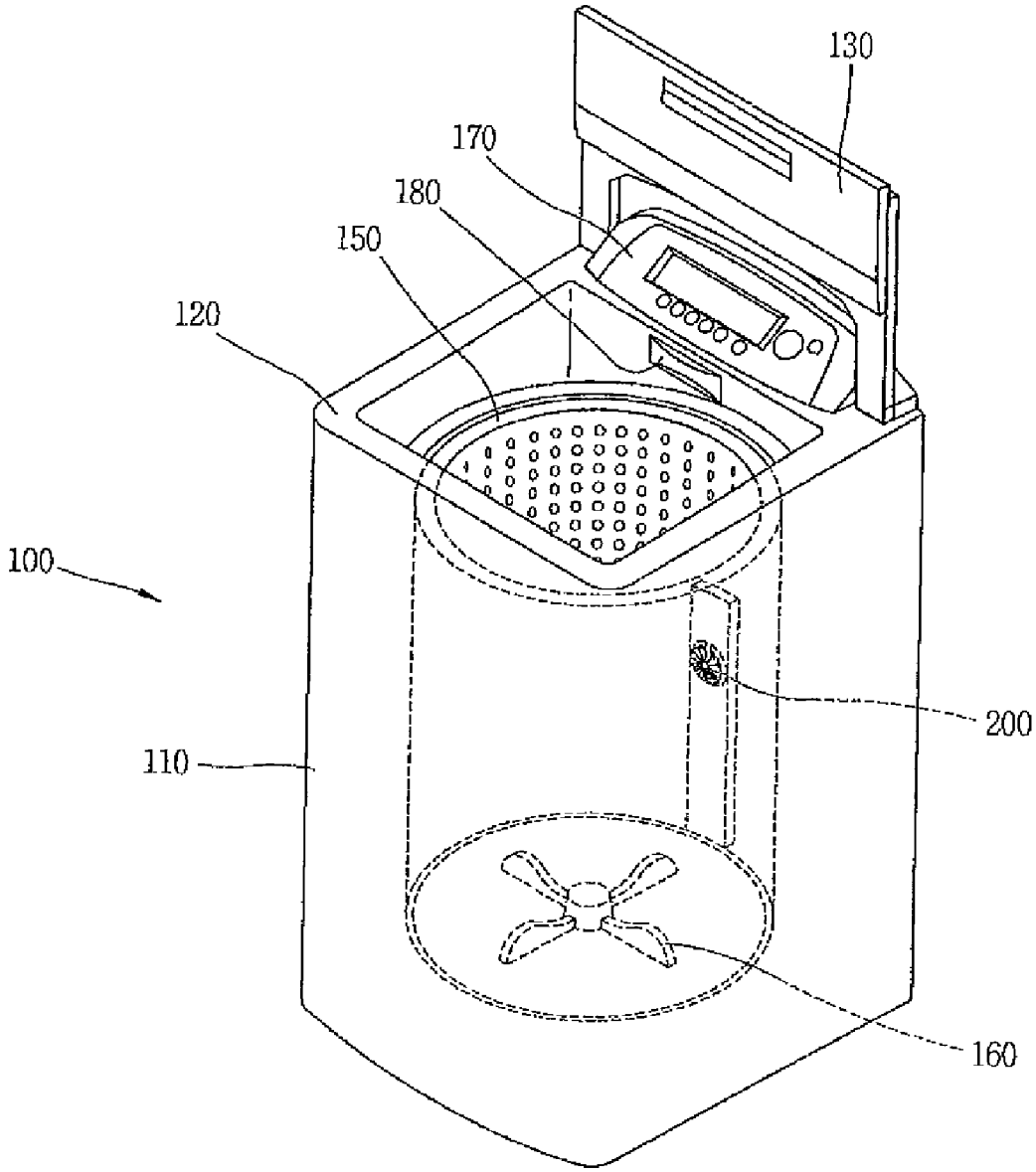
FIGS. 1 and 2 are respectively perspective and longitudinal sectional views of a pulsator type washing machine to which a foreign materials filtering apparatus according to the present invention is applied.
Figure 2:
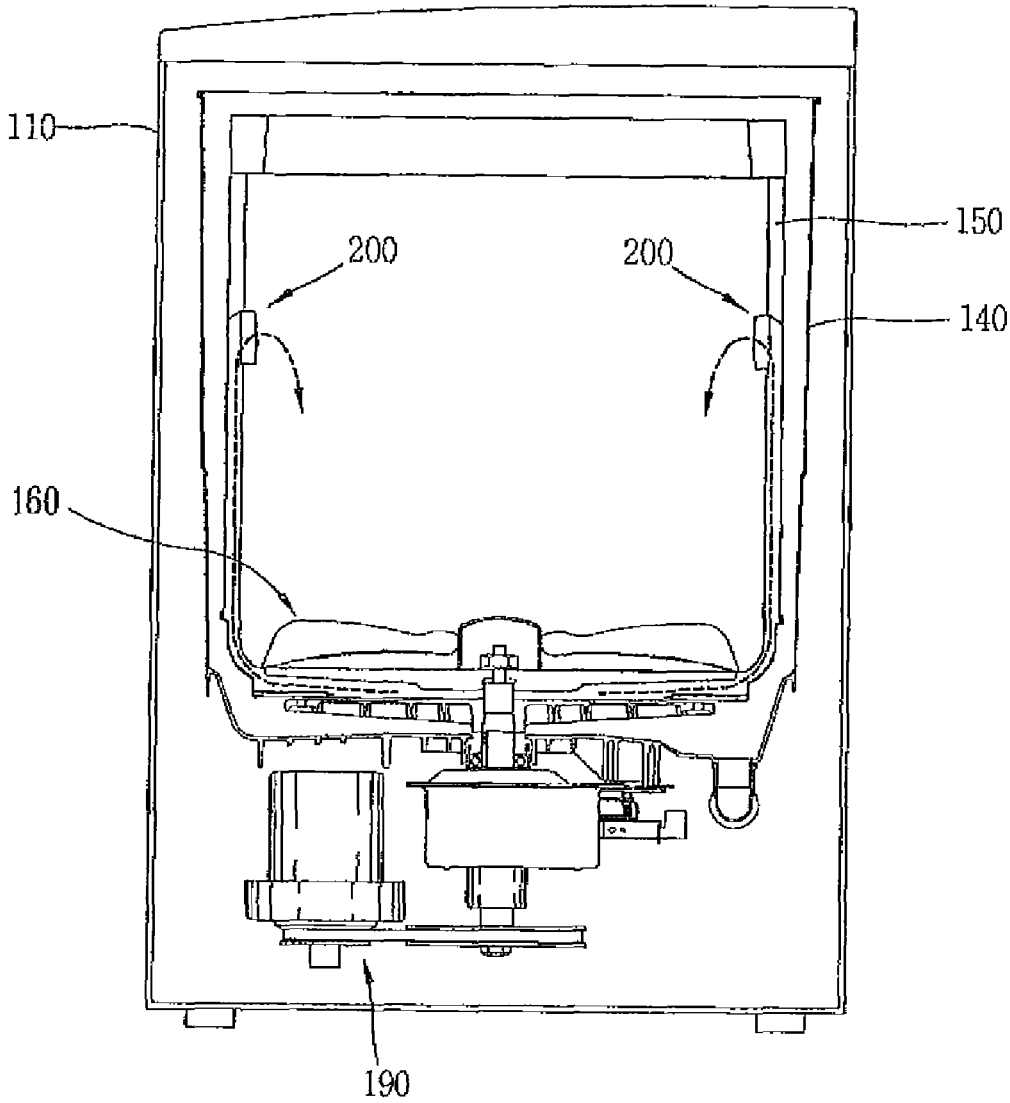

FIGS. 1 and 2 are respectively perspective and longitudinal sectional views of a pulsator type washing machine to which a foreign materials filtering apparatus according to the present invention is applied.

As shown, a washing machine 100 to which a foreign materials filtering apparatus according to the present invention is applied, comprises: a cabinet 110 that forms the appearance; a top cover 120 mounted at an upper side of the cabinet 110; and a lid 130 mounted at an upper side of the top cover 120, for opening and closing a washing tub 150 to be later explained.

A reservoir 140 for containing washing waster therein is installed in the cabinet 110, and a washing tub 150 containing laundry therein and washing the laundry while rotating is installed in the washing tub 140. A pulsator 160 for stirring laundry is installed at a lower surface of the washing tub 150, and a foreign materials filtering apparatus 200 is installed at a part on an inner wall of the washing tub 150.

A control panel 170 for controlling an operation of the washing machine is installed at one side of the top cover 120, and a detergent box 180 is inserted into an inner inclination surface of the top cover 120.

Unexplained reference numeral 190 denotes a driving unit.

The operation of the washing machine according to the present invention will be explained.

First, laundry is put into the washing tub 150, and washing conditions are inputted by pressing a course selection button, etc. mounted at the control panel 170. Then, an operation button is pressed to start a washing process, and thereby washing water is introduced into the washing tub 150. As the washing water reaches a certain level, the pulsator 160 rotates thus to start a washing process.

As the pulsator 160 rotates, a centrifugal force is applied to the washing water. By the centrifugal force, the washing water is moved toward an inner wall of the washing tub 150, and circulates along the inner wall. As the washing tub 150 and the pulsator 160 alternately rotate with a certain time gap therebetween in opposite directions to each other, a washing process is performed while water current and laundry are mixed to each other. Here, the washing water passes through the foreign materials filtering apparatus 200 while circulating toward inside of the washing tub 150. As the washing water passes through the foreign materials filtering apparatus 200, foreign materials such as nap mixed with the washing water are filtered by the foreign materials filtering apparatus 200.

FIGS. 3 to 10 are views respectively showing a foreign materials filtering apparatus according to the present invention.

Figure 3:
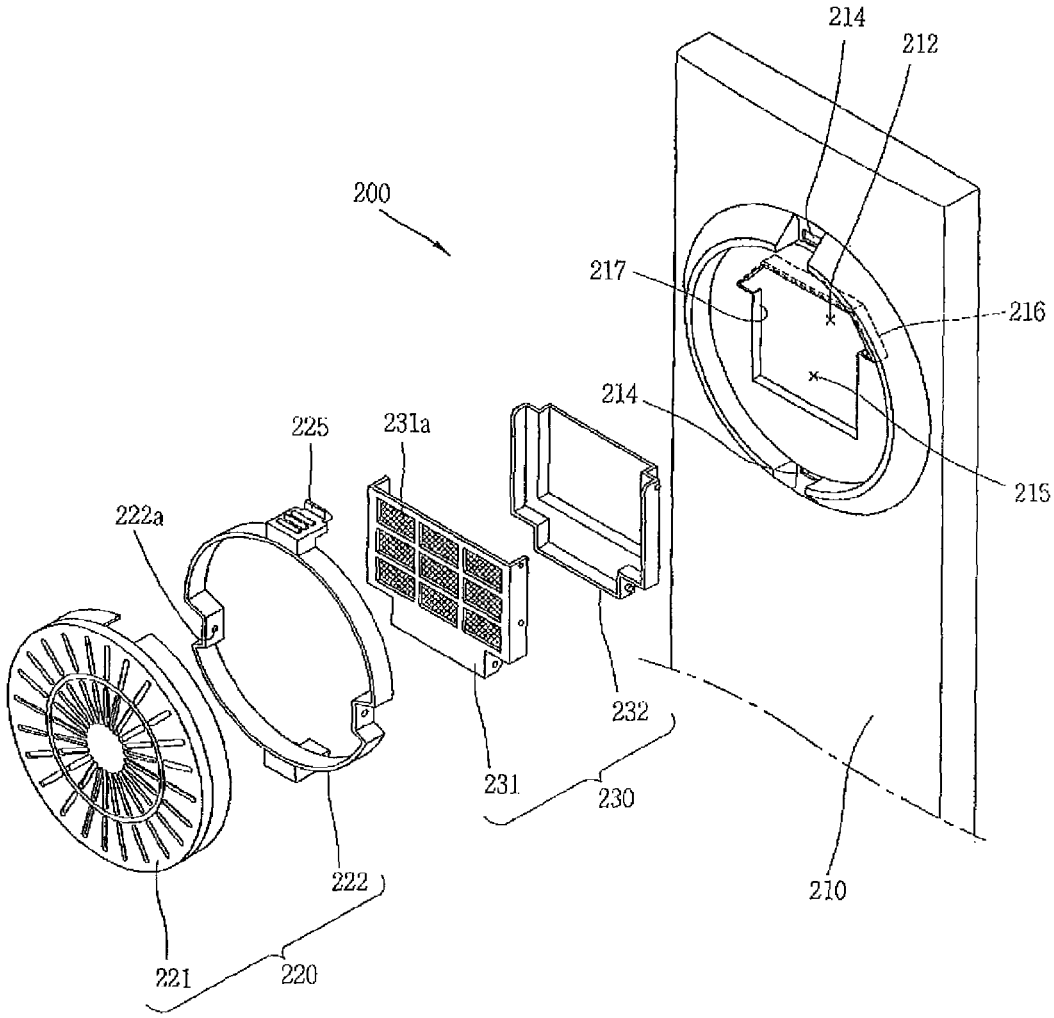
FIG. 3 is a frontal exploded perspective view of the foreign materials filtering apparatus of FIG. 1.
Figure 4:
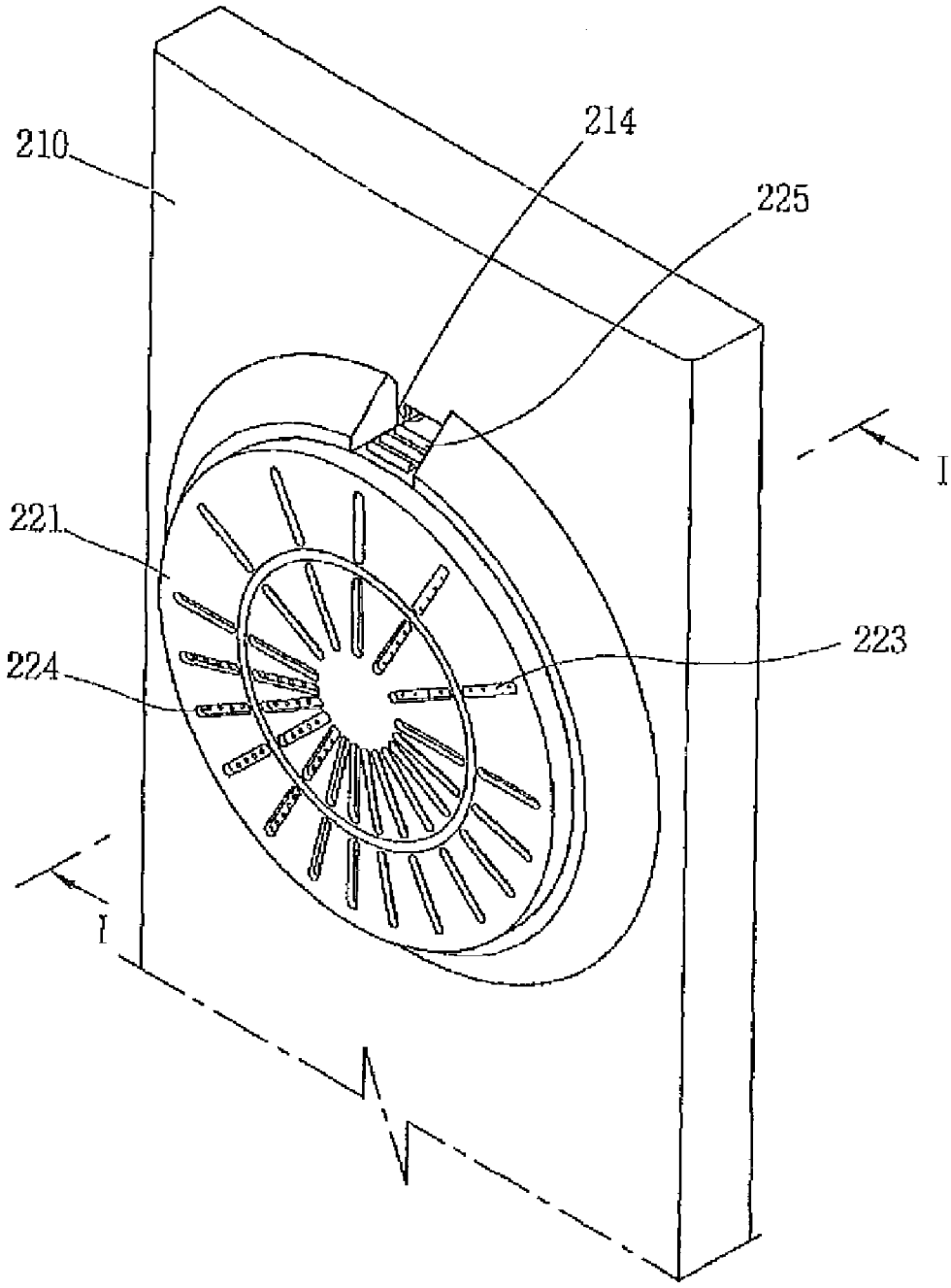
FIG. 4 is a frontal assembled perspective view of the foreign materials filtering apparatus of FIG. 1.

As shown in FIG. 3, a foreign materials filtering apparatus 200 according to the present invention comprises a washing water circulating duct 210 installed on an inner wall surface of a washing tub 150 of FIG. 1, a filter cover 220 detachably mounted at the washing water circulating duct 210, and a filter unit 230 disposed on a rear surface of the filter cover 220 for filtering foreign materials from washing water.

As shown in FIGS. 3 to 6, the washing water circulating duct 210 is formed in a rectangular plate shape approximately same as an inner all surface of the washing tub 150. At right and left sides of a rear surface of the washing water circulating duct 210, provided is a washing water guiding protrusion 211 long protruded in a vertical direction so as to form a washing water guiding passage (F) together with an inner circumferential surface of the washing tub 150. One or more washing water inlets 212 are formed inside the washing water guiding passage (F) at a nearly intermediate height of the washing water circulating duct 210. A cover mounting groove 213 for mounting the filter cover 220 is formed at the periphery of a front surface of the washing water inlet 212. A hook groove 214 for detachably mounting a hook protrusion 225 of a handle 222 to be later explained is formed at upper and lower sides of the cover mounting groove 213, respectively. Here, the hook protrusion may be formed at the washing water circulating duct, and the hook groove may be formed at the filter cover.

Figure 5:
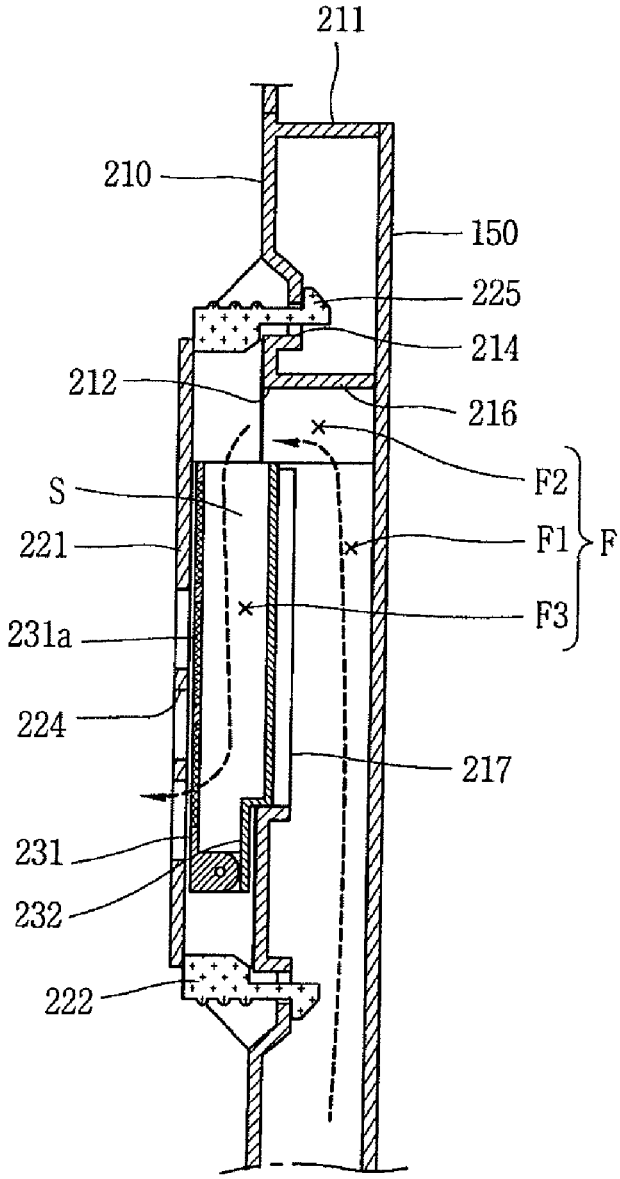
FIG. 5 is a lateral longitudinal sectional view of the foreign materials filtering apparatus of FIG. 1 taken along line 'I-I'.

The washing water inlet 212 may be formed in the same shape regardless of the kind of the filter unit 230, and may be formed in different shapes according to the kind of the filter unit 230. As shown in FIGS. 3 and 5, when the filter unit 230 is formed in a rectangular box shape having a foreign materials filtering space (S) having a passage F provided with a first passage F1, a second passage F2, and a third passage F3 between a front filter 231 and a rear filter 232, a filter inserting groove 215 for inserting the rear filer 232 of the filter unit 230 is extendingly formed below the washing water inlet 212 in an approximately rectangular shape, thereby increasing the foreign materials filtering space (S) by a thickness of the rear filter 232.

Figure 7:
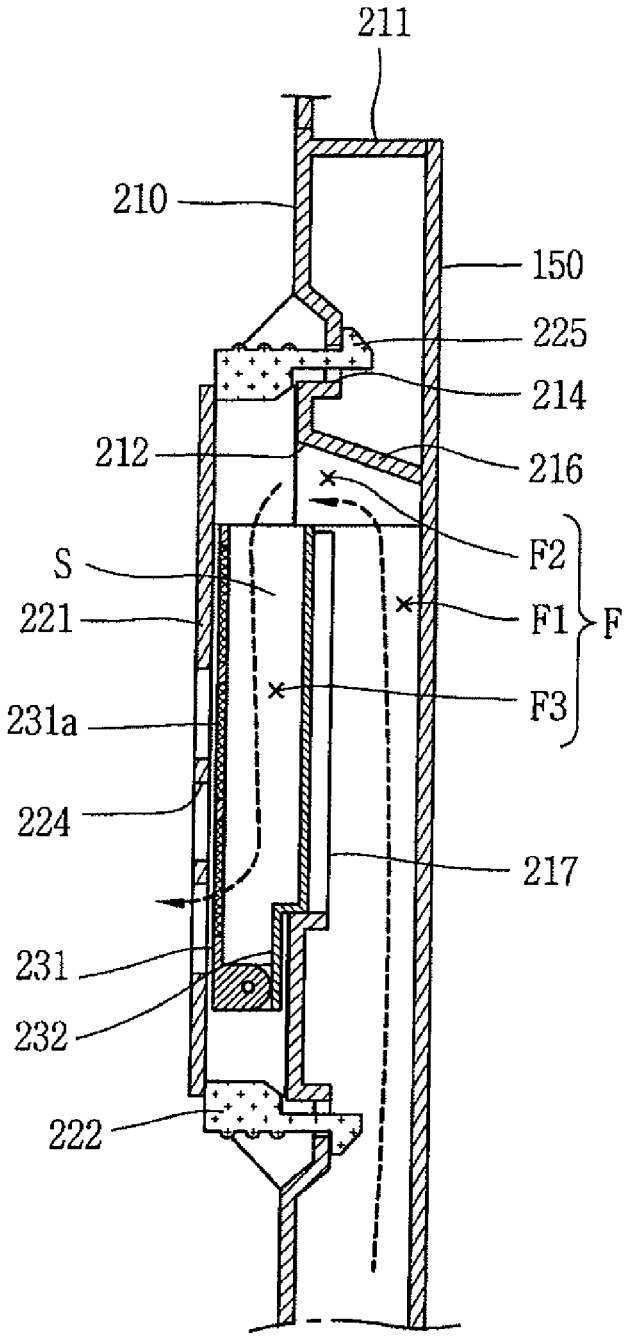
FIGS. 7 and 8 are longitudinal sectional views showing another embodiment of a water direction changing rib of the foreign materials filtering apparatus of FIG. 1.
Figure 8:
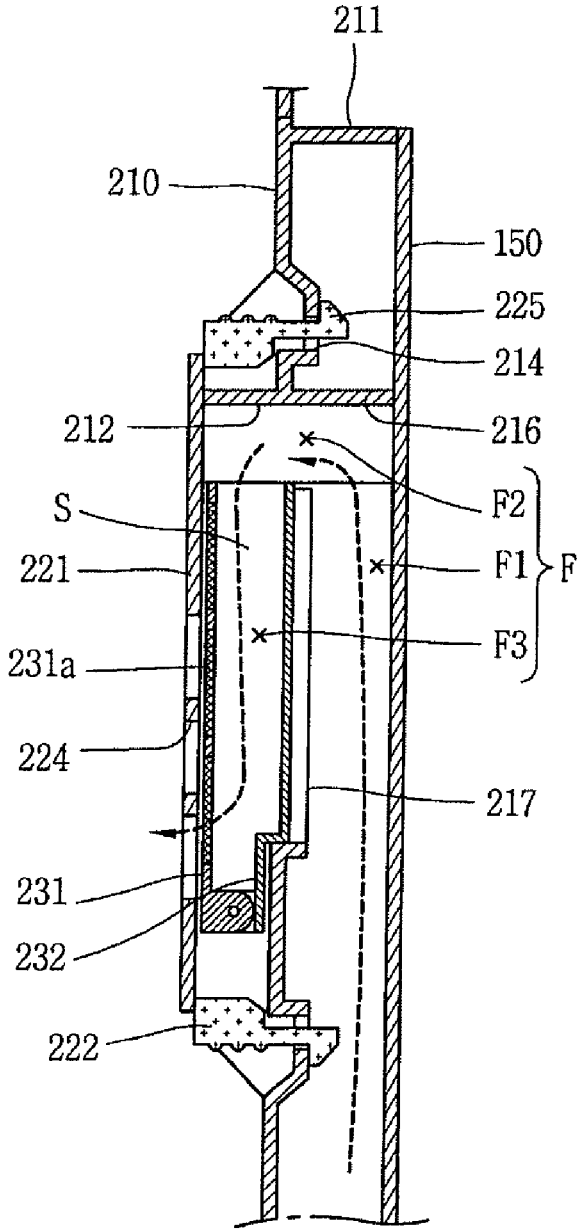

As shown in FIGS. 3 and 5, a water direction changing rib 216 for changing a direction of upwardly flowing washing water thereby introducing into the washing water inlet 212 is long formed at right and left sides of an upper rear surface of the washing water inlet 212. As shown in FIG. 5, the water direction changing rib 216 may be formed to be perpendicular to the rear surface of the washing water circulating duct 210. However, as shown in FIG. 7, the water direction changing rib 216 may be formed to be perpendicular to a flow direction of washing water, thereby effectively introducing the washing water into the washing water inlet 212. Preferably, the water direction changing rib 216 may be formed to have an approximately same height as the washing water guiding protrusion 211 so that its end can come in contact with or can be closer to the washing tub 150, thereby increasing an introduction amount of washing water into the filter unit 230. As shown in FIG. 8, the water direction changing rib 216 may be formed at the same height not only on the rear surface but also on the front surface of the washing water inlet 212. Here, the water direction changing rib 216 formed on the front surface of the washing water inlet 212 preferably has a height high enough to come in contact with a rear surface of the cap 221, thereby increasing an introduction amount of washing water into the filter unit 230. The water direction changing rib 216 may be formed so that its center side is parallel to the ground in left and right directions, but its right and left sides are downwardly inclined toward both ends so as to collect water.

Preferably, the water direction changing rib 216 may be extendingly formed at an upper cut-out portion or right and left cut-out portions of the washing water inlet so as to decrease a flow resistance when a flow direction of washing water is converted to the washing water inlet 212.

The water direction changing rib 216 may be formed at a front upper side of the washing water circulating duct 210 where the filter unit 230 is mounted. Here, the water direction changing rib 216 may be formed on the front surface of the washing water circulating duct 210 with the same specification as that formed on the rear surface of the washing water circulating duct 210.

As shown in FIGS. 3 and 5, a water barrier rib 217 for preventing foreign materials from being introduced into a gap of a coupled part between the washing water circulating duct 210 and the filter unit 230 is formed at lower, right and left sides of the rear surface of the washing water inlet 212. For instance, when the rear filter 232 of the filter unit 230 is inserted into a lower portion of the washing water inlet 212, a small gap may occur between the rear filter 232 and the filter inserting groove 215, thereby allowing foreign materials mixed with the washing water to be introduced into the gap. To this end, the water barrier rib 217 for allowing washing water not to pass through a gap between the filter inserting groove 215 and the rear filter 232 by jumping is extendingly formed at a cut-out surface of the filter inserting groove 215.

Figure 6:
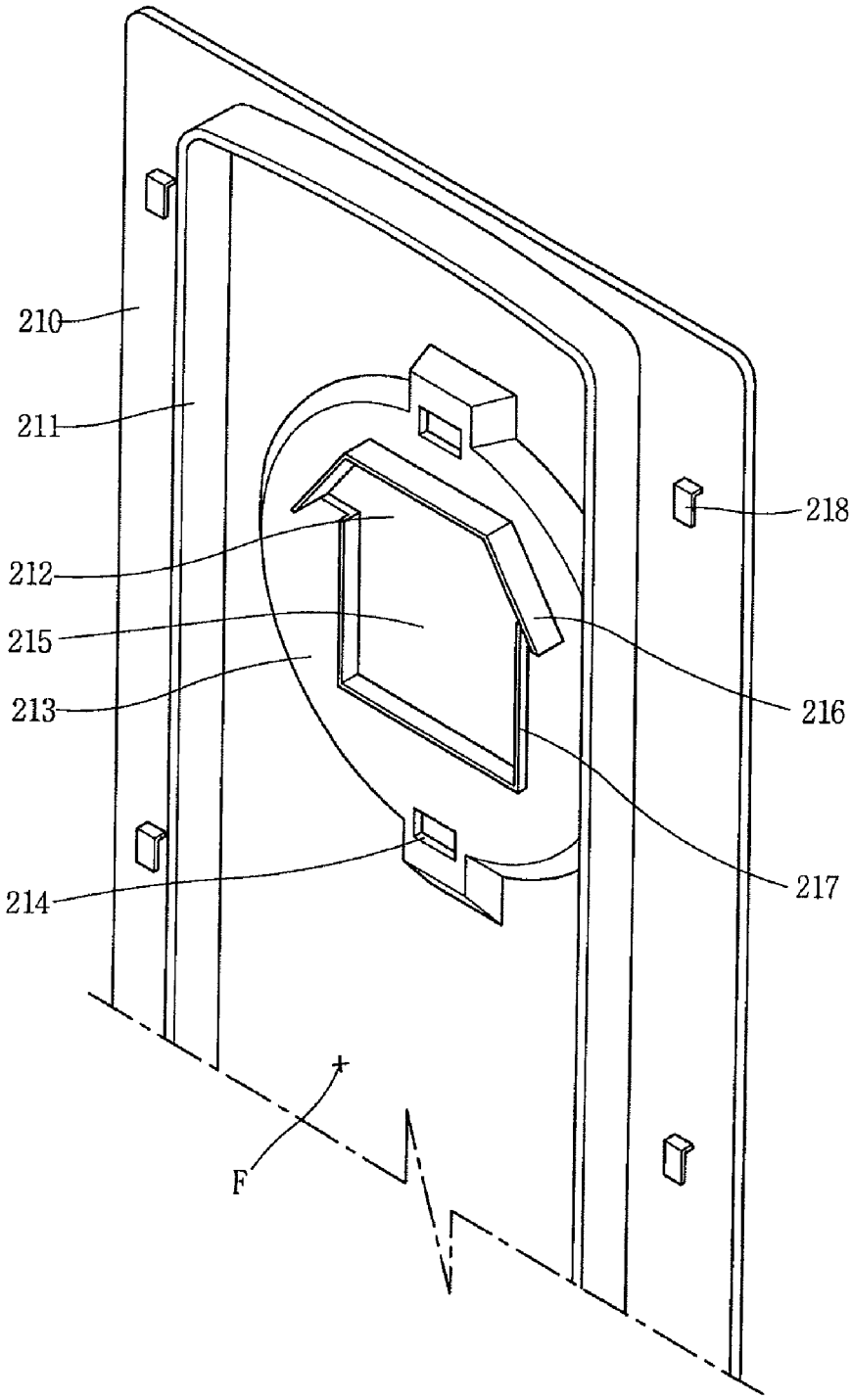
FIG. 6 is a rear perspective view of a washing water circulating duct of the foreign materials filtering apparatus of FIG. 1.

As shown in FIG. 5, the water barrier rib 217 may be formed so that an interval between its end and an inner circumferential surface of the washing tub 150 can be less than ½ of an interval between the washing water circulating duct 210 and the washing tub 150, thereby allowing washing water to flow therethrough, As shown in FIG. 6, the water barrier rib 217 may be integrally extended along lower, right and left cut-out surfaces of the filter inserting groove 215. Although not shown, the water barrier rib 217 may be also formed as protrusions having a certain interval therebetween.

As shown in FIG. 5, the water barrier rib 217 may be formed to be perpendicular to the rear surface of the washing water circulating duct 210, or may be formed to be inclined or curved in a flow direction of washing water. The water barrier rib 217 may be also formed to be inclined or curved in a direction opposite to a flow direction of washing water. When the water barrier rib 217 is formed in a flow direction of washing water, washing water can be smoothly supplied to the washing water inlet 212 due to a decreased flow resistance. On the contrary, when the water barrier rib 217 is formed in a direction opposite to a flow direction of washing water, foreign materials of washing water is more effectively prevented from being introduced into the gap owing to an enhanced 'jumping effect' of the washing water.

Figure 9:
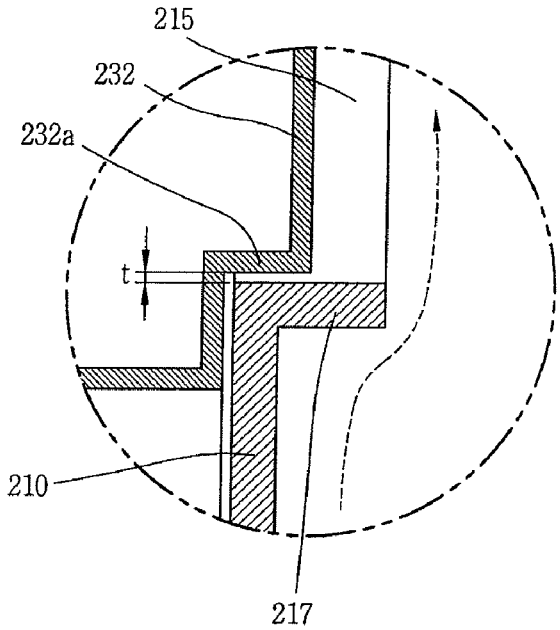
FIGS. 9 and 10 are longitudinal sectional views showing each embodiment of a water barrier rib of the foreign materials filtering apparatus of FIG. 1.
Figure 10:
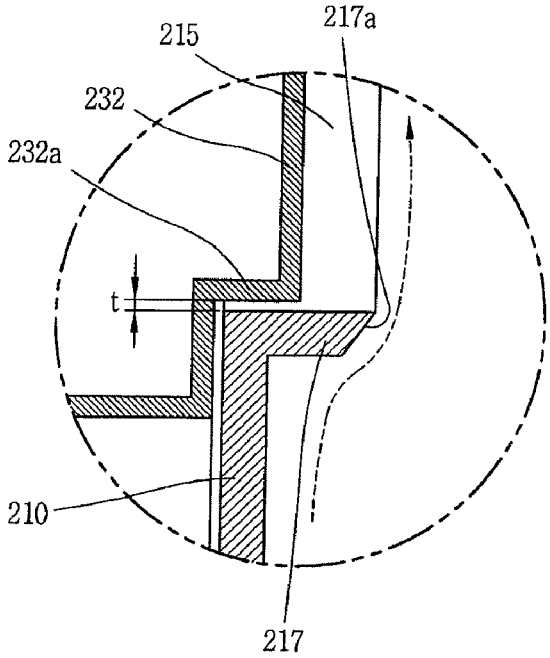

As shown in FIG. 9, the water barrier rib 217 may be formed to have a planar end, and may be provided with a water guiding surface 217*a* seen in FIG. 10, so as to be inclined or curved in a flow direction of washing water. Although not shown, the water barrier rib 217 may be formed to be inclined or curved in a direction opposite to a flow direction of washing water. The rear filter 232 has a supporting protrusion 232*a* allowing the rear filter 232 to follow the contour of the water barrier rib 217 and water guiding surface 217*a*.

Unexplained reference numeral 218 denotes a duct fixing protrusion, 231*a* denotes a filter unit, 232 denotes a minute hole, and 224 denotes a drain hole.

Hereinafter, processes for filtering foreign materials from the washing machine to which the foreign materials filtering apparatus is applied will be explained.

First, once the pulsator 160 rotates to generate a water current, washing water is moved toward an inner wall surface of the washing tub 150 by a centrifugal force due to the water current. The washing water rises along the washing water guiding protrusion 211 of the washing water circulating duct 210 mounted on the inner wall surface of the washing tub 150, and then is introduced into the foreign materials filtering space (S) having a passage F provided with a first passage F1, a second passage F2, and a third passage F3 of the filter unit 230 through the washing water inlet 212 formed at an intermediate height of the washing water circulating duct 210. Accordingly, foreign materials of the washing water are filtered by the filter unit 231*a* of the front filter 231, and the washing water is introduced into the washing tub 150 through the drain holes 224 of the filter cover 220 thus to circulate.

As shown in FIGS. 7 to 9, the washing water rising along the washing water guiding passage (F) of the washing water circulating duct 210 is blocked by the water direction changing rib 216 formed at an upper part of a rear or front surface of the washing water inlet 212. Accordingly, the washing water has a converted flowing direction thus to be introduced into the washing water inlet 212. As a result, a large amount of washing water passes through the filter unit 230.

When the rear filter 232 of the filter unit 230 is inserted into the filter inserting groove 215 of the washing water circulating duct 210, rising washing water passes through a gap (t) between the filter inserting groove 215 and the rear filter 232 before being introduced into the filter unit 230. However, as shown in FIGS. 9 and 10, rising washing water does not pass through the gap (t) with jumping due to the water barrier rib 217 formed at the periphery of the filter inserting groove 215. Accordingly, foreign materials of the washing water are prevented from being introduced into the gap (t).

The foreign materials filtering apparatus and the washing machine having the same according to the present invention has the following advantages.

First, the filter unit is not exposed to inside of the washing tub thus not to directly come in contact with laundry, thereby preventing the filter unit and laundry from being damaged and enhancing the entire appearance.

Second, the amount of washing water passing through the foreign materials filtering apparatus is increased to effectively refine the washing water, thereby enhancing a washing effect.

Third, washing water is prevented from being introduced into a gap between the washing water circulating duct and the filter unit, thereby preventing contamination of the washing water and facilitating a detachable mounting of the filter unit.

The foregoing embodiments and advantages are merely exemplary and are not to be construed as limiting the present invention. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A foreign materials filtering apparatus, comprising:

a washing water circulating duct having one or more washing water inlets, the washing water circulating duct spaced from a washing tub to form a first passage between the washing tub and the washing water circulating duct through which water flows;

a filter inserting groove extending downwardly from the washing water inlet;

a filter cover including a cap having a drain hole through which washing water introduced through the washing inlet is guided into the washing tub;

a handle on the cap and coupled to the washing water circulating duct; and a filter unit disposed between the washing water circulating duct and the filter cover, and including a rear filter and a front filter, the rear filter supported by the filter inserting groove such that the washing water inlet is open but the filter inserting groove is closed, the front filter spaced from a side surface of the rear filter and coupled to the rear filter to form a third passage, the front filter having closed lower and side surfaces and an open upper surface to communicate with the washing water inlet, a front surface of the front filter provided with a filter portion to communicate with the drain hole, wherein a water direction changing rib is formed above the washing water inlet of the washing water circulation duct and faces the washing tub to form a second passage, the second passage for introducing washing water which passes through the filter inserting groove blocked by the rear cover into the washing water inlet, and for guiding the washing water into the third passage between the front filter and the rear filter.

2. The foreign materials filtering apparatus of claim 1, wherein the water direction changing rib is formed at the periphery of the washing water inlets.

3. The foreign materials filtering apparatus of claim 1, wherein the water direction changing rib is formed so that its end can approximately come in contact with an inner circumferential surface of the washing tub.

4. The foreign materials filtering apparatus of claim 1, wherein the water direction changing rib is formed so as to be inclined from a plane of the washing water circulating duct.

5. The foreign materials filtering apparatus of claim 1, wherein a water barrier rib is further formed at a lower end of the filter inserting groove, the water barrier rib protruding in a direction of the washing tub.

6. The foreign materials filtering apparatus of claim 5, wherein a supporting protrusion is formed in the rear filter and is supported by the filter inserting groove, and wherein the water barrier rib protrudes further toward the washing tub than the supporting protrusion.

7. The foreign materials filtering apparatus of claim 6, wherein the water barrier rib is formed so as to have a height less than ½ of an interval between the washing water circulating duct and the washing tub.

8. The foreign materials filtering apparatus of claim 6, wherein the water direction changing rib is formed so that its edge can be inclined or curved.

* * * * *